US005376485A

United States Patent [19]

Yoshihara

[11] Patent Number: 5,376,485

[45] Date of Patent: Dec. 27, 1994

[54] PHOTOSENSITIVE MEMBER, ELECTROPHOTOGRAPHIC APPARATUS AND IMAGE FORMING METHOD USING SAME

[75] Inventor: Toshiyuki Yoshihara, Inagi, Japan

[73] Assignee: Canon Kabushiki Kaisha, Tokyo, Japan

[21] Appl. No.: 611,642

[22] Filed: Nov. 13, 1990

[30] Foreign Application Priority Data

Nov. 13, 1989 [JP] Japan ..... 1-292184

[51] Int. Cl.[5] ..... G03G 5/06

[52] U.S. Cl. ..... 430/58; 430/78

[58] Field of Search ..... 430/58, 78, 79

[56] References Cited

U.S. PATENT DOCUMENTS

| | | | |
|---|---|---|---|
| 4,664,997 | 5/1987 | Suzuki et al. | 430/58 |
| 4,725,519 | 2/1988 | Suzuki et al. | 430/58 |
| 4,728,592 | 3/1988 | Ohaku et al. | 430/59 |
| 4,882,427 | 11/1989 | Enokida et al. | 540/141 |
| 4,898,799 | 2/1990 | Fukimaki et al. | 430/59 |

FOREIGN PATENT DOCUMENTS

| | | | |
|---|---|---|---|
| 0277039 | 8/1988 | European Pat. Off. | G03G 5/06 |
| 0308185 | 3/1989 | European Pat. Off. | G03G 15/02 |
| 0329366 | 8/1989 | European Pat. Off. | |

*Primary Examiner*—John Goodrow

*Attorney, Agent, or Firm*—Fitzpatrick, Cella, Harper & Scinto

[57] ABSTRACT

An photosensitive member suitable for use in the electrophotographic apparatus of reversal development-type is formed by an electroconductive support, a charge-generation layer and a charge-transport layer disposed in this order. The charge-generation layer comprises oxytitanium phthalocyanine and the charge-transport layer is formed in a thickness of 22 microns or larger. The oxytitanium phthalocyanine is highly sensitive so that a low dark-part potential of 600V or lower (absolute) is sufficient. Because of the low dark-part potential and the thick charge transport layer, image defect, such as fog and black spots are effectively suppressed.

7 Claims, 2 Drawing Sheets

PHOTOSENSITIVE MEMBER, ELECTROPHOTOGRAPHIC APPARATUS AND IMAGE FORMING METHOD USING SAME

FIELD OF THE INVENTION AND RELATED ART

The present invention relates to an electrophotographic photosensitive member, and an electrophotographic apparatus and an image forming method using the same. More specifically, the present invention relates to an electrophotographic photosensitive member capable of providing high-quality images free from image defects, such as fog and black spots, and an electrophotographic apparatus and an image forming method using the photosensitive member.

In recent years, there has been a rapidly increasing demand for electrophotographic printers, such as a laser beam printer, an LED printer, an LCD printer, etc., as outputting means for computers, word processors and facsimile machines.

Electrophotographic photosensitive members used at present for such printers especially those utilizing organic photoconductors, have basically adopted a so-called function separation-type structure. Such structure includes a charge-generation layer containing a charge-generating material and a charge-transport layer containing a charge-transporting material. Advantages of such a structure include latitude for material selection, durability, electro-potential stability, sensitivity, and response characteristic.

In such electrophotographic printers, particularly in a digital-type printer, the image input is mostly effected by the reversal mode, and in this case, electrostatic (latent) images are also developed according to the reversal development mode. In reversal development, the dark part of an electrostatic latent image provides a white ground area of the developed image, so that there is a problem that a potential decrease in the form of minute spots due to carrier injection from the substrate is liable to appear as noticeable image defects, such as fog in the white background or black spots.

In order to prevent such image defects as fog and black spots, the following measures have been representatively taken heretofore:

(1) To dispose an undercoating layer capable of preventing carrier injection between the substrate and the charge generation layer.

(2) To use a charge transport material having a low carrier mobility.

(3) To heat the photosensitive member by using a heater in view of a fact that in a high humidity environment, the resistivity of the charge generation layer or the undercoating is liable to be lowered to promote carrier injection.

However, none of the above measures has shown sufficient beneficial effect but is accompanied with some adverse effect.

On the other hand, as the light sources of electrophotographic printers and digital copying machines, semiconductor lasers have been used in many cases, and oxytitanium phthalocyanine has attracted attention as a charge-generating material having a high sensitivity in the neighborhood of 780–800 nm, i.e., emission wavelengths of the semiconductor lasers. Oxytitanium phthalocyanine has not only a high sensitivity but also has excellent electrophotographic characteristics, so that it is suitable as a material for photosensitive members of electrophotographic printers and digital copying machines. However, it has been very difficult to prevent the above-mentioned occurrence of fog in a white background by using oxytitanium phthalocyanine. The fog defect remarkably impairs the image quality, so that the solution thereof has been desired.

SUMMARY OF THE INVENTION

An object of the present invention is to provide an electrophotographic photosensitive member having solved the above-mentioned problems and being capable of providing high-quality images free from fog in the reversal development process, an electrophotographic apparatus containing the photosensitive member and an image forming method using the photosensitive member.

According to the present invention, there is provided an electrophotographic photosensitive member to be used in an electrophotographic apparatus provided with charging means and reversal developing means, comprising: an electroconductive support, a charge-generation layer and a charge transport layer, in this order; wherein the charge generation layer comprises oxytitanium phthalocyanine, and the charge transport layer has a thickness of 22 microns or larger.

According to another aspect of the present invention, there is provided an electrophotographic apparatus, comprising:

an electrophotographic photosensitive member, charging means and reversal developing means; wherein said charging means is a means for providing a dark-part potential of 600V or lower in terms of absolute value to the surface of the photosensitive member; the photosensitive member comprises an electroconductive support, a charge-generation layer and a charge transport layer, in this order; the charge generation layer comprises oxytitanium phthalocyanine, and the charge transport layer has a thickness of 22 microns or larger.

According to still another aspect of the present invention, there is provided an image forming method, comprising:

charging an electrophotographic photosensitive member to provide a dark-part potential of 600V or lower in terms of absolute value; said electrophotographic photosensitive member comprising an electroconductive support, a charge-generation layer and a charge transport layer, in this order; the charge generation layer comprising oxytitanium phthalocyanine, the charge transport layer having a thickness of 22 microns or larger;

forming an electrostatic latent image on the surface of the electrophotographic photosensitive member; and reversely developing the electrostatic latent image thus formed.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
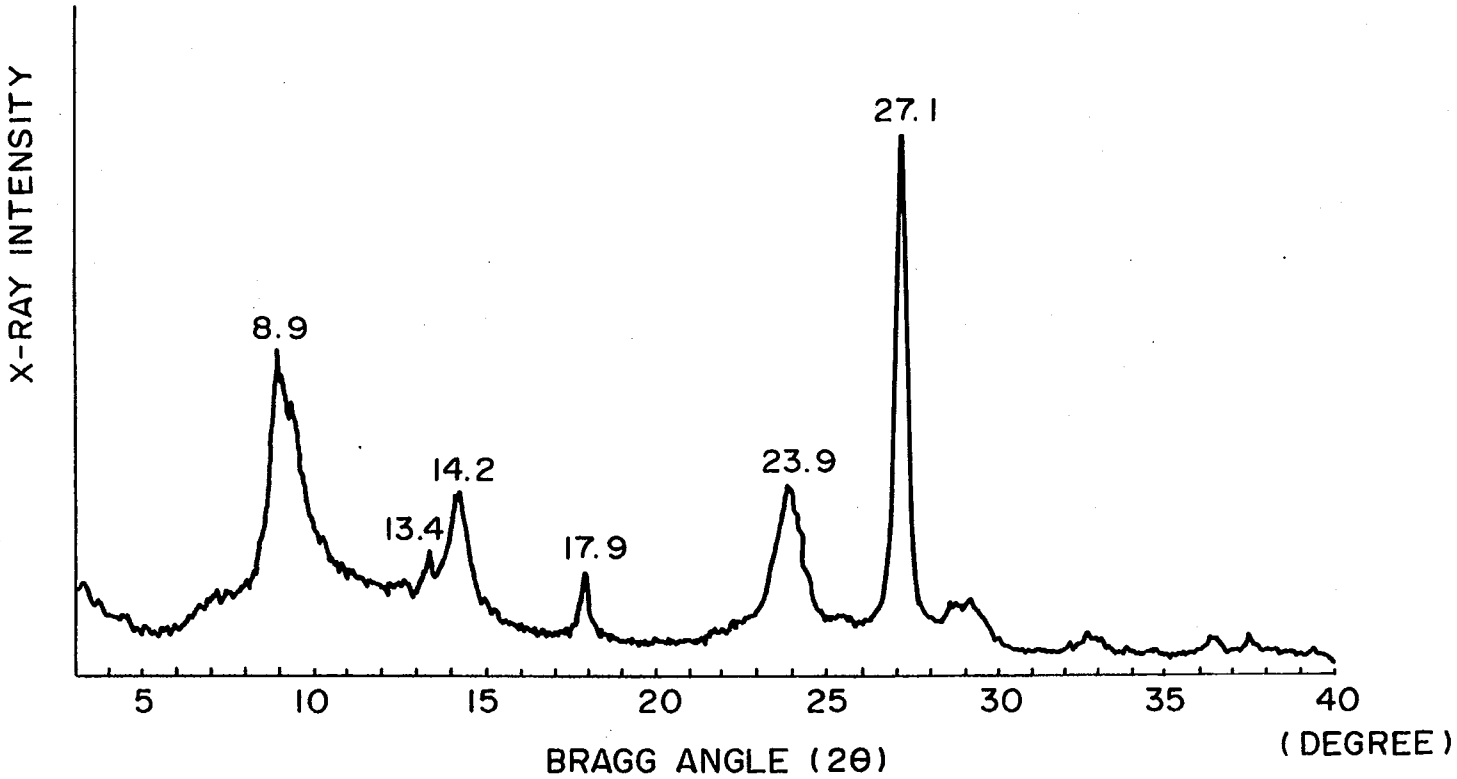
FIG. 1 is a graph showing an X-ray diffraction pattern of oxytitanium phthalocyanine prepared in Synthesis Example 2 described hereinafter.

In the electrophotographic photosensitive member according to the present invention, it is essential that the charge transport layer has a thickness which is larger than the one conventionally used. The reason therefor is not necessarily clear but may be that a thicker charge transport layer can provide a smaller electric field intensity than a thinner charge transport layer when a certain surface potential is provided to the photosensitive member so that the above-mentioned charge injection from the substrate is suppressed. Another reason may be that a developing step can be completed before carriers reach the photosensitive member surface if the photosensitive member has a thick charge transport layer, i.e., a long distance for migration of the carriers.

In the present invention, the charge transport layer may have a thickness of 22 microns or larger, preferably 25 microns or larger.

The upper limit of the thickness may be appropriately set within a range which provides a desired sensitivity. In view of the uniformity of the film formed by coating, the charge transport may preferably have a thickness of 50 microns or smaller, particularly 35 microns or smaller.

In the present invention, the dark part potential on the photosensitive member (hereinafter denoted by "Vd") at the time of electrostatic latent image formation is set to a smaller value than before. More specifically, the dark part potential (Vd) may preferably be set to 600V or lower, particularly 550V or lower, in terms of the absolute value.

The lower limit of Vd may be desirably set within an extent of providing a sufficient development contrast but may preferably 250V or higher, particularly 300V or higher.

Hitherto, Vd has been set to around 700V in terms of the absolute value. A reason therefor is that a combination of a higher Vd and a lower light-part potential (hereinafter denoted by "VI") providing a sufficient potential difference therebetween has been desired to provide a sufficient margin against a potential change due to repetitive use of the photosensitive member and environmental change so as to stably provide a high contrast image.

However, I have found that oxytitanium phthalocyanine as a charge-generating substance has a sufficiently high sensitivity so that it provides a sufficient contrast even at a low Vd and shows very little change in repetitive use or environmental change, thus stably providing good images.

Thus, according to the present invention, in an electrophotographic photosensitive member having a charge-generation layer containing oxytitanium phthalocyanine, wherein the charge transport layer is made thick and the dark-part potential (Vd) is set low, then image defects such as fog and black spots have been substantially removed for the first time as a synergistic effect of these factors.

Next, the structure of the electrophotographic photosensitive member is more specifically described.

The electroconductive support may be a support which per se comprises an electroconductive material, such as aluminum, aluminum alloy, copper, zinc, stainless steel, vanadium, molybdenum, chromium, titanium, nickel, indium, gold or platinum; a plastic substrate coated with a film of aluminum, aluminum alloy, indium oxide, tin oxide, indium oxide tin oxide composite (ITO), etc., by vapor deposition; a plastic or paper substrate impregnated with electroconductive particles; or a plastic support comprising an electroconductive polymer.

In the photosensitive member of the present invention, it is possible to dispose an undercoating or primer layer showing both a barrier function and an adhesive function between the electroconductive support and the charge generation layer.

The undercoating layer may be formed from a substance, such as casein, polyvinyl alcohol, nitrocellulose, ethylene-acrylic acid copolymer, polyvinyl butyral, phenolic resin, polyamides (inclusive of nylon 6, nylon 66, nylon 610, copolymer nylon, alkoxymethylated nylon etc.), polyurethane, gelatin, or aluminum oxide.

The undercoating layer may preferably have a thickness of 0.1–10 microns, particularly 0.1–3 microns.

Between the support and the undercoating layer, it is also possible to form a coating for compensating surface defects of the support, or an electroconductive layer for preventing interference fringes due to scattering in the case where image input is provided by laser light.

The electroconductive layer may be formed as a layer comprising an electroconductive powder such as carbon black, metal powder, or metal oxide powder in an appropriate binder resin. The electroconductive layer may preferably have a thickness of 5–40 microns, particularly 10–30 microns.

The electrophotographic photosensitive member according to the present invention can further have a surface resin layer or electroconductive resin layer as a surface protective layer on the photoconductive layers. The surface protective layer may preferably have a thickness of 0.1–5 microns, particularly 0.2–3 microns.

Next, oxytitanium phthalocyanine used in the present invention as a charge-generating substance is explained. The oxytitanium phthalocyanine is a compound which may be represented by the following formula:

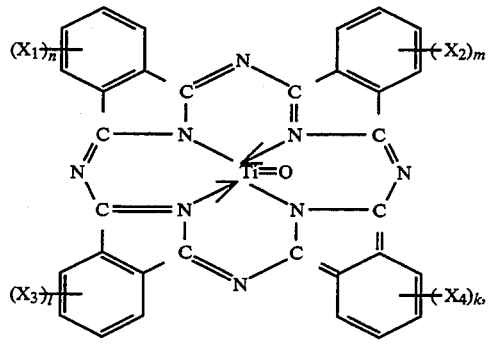

wherein $X_1$, $X_2$, $X_3$ and $X_4$ respectively denote Cl or Br; and n, m, l and k are respectively an integer of 0–4.

Synthesis process and electrophotographic characteristics of oxytitanium phthalocyanine have been disclosed by, e.g., Japanese Laid-Open Patent Applications (JP-A) 57-148745, 59-36254, 59-44054, 59-31965, 61-239248 and 62-67904. In the present invention, oxytitanium phthalocyanines produced according to the disclosures of the above publications may be used as a charge-generating material.

Among various types of oxytitanium phthalocyanines, it is particularly advantageous in the present invention to use oxytitanium phthalocyanine having a crystal form showing strong peaks specified by Bragg angles ($2\theta \pm 0.2$ degree) of 9.0 degrees, 14.2 degrees, 23.9 degrees and 27.1 degrees in X-ray diffraction pattern based on CuK$\alpha$ characteristic X-rays, which shows a very high sensitivity and a relatively low resistivity, so that carriers are easily injected.

The charge-generation layer comprising oxytitanium phthalocyanine may be formed by vapor deposition thereof onto the support or by coating the support with a coating liquid formed by dispersing oxytitanium phthalocyanine in a resinous liquid comprising a binder resin, such as phenolic resin, urea resin, melamine resin, epoxy resin, silicone resin, vinyl chloride-vinyl acetate copolymer, butyral resin, xylene resin, urethane resin, acrylic resin, polycarbonate resin, polyacrylate resin, saturated polyester resin or phenoxy resin in the form of a dispersion or a solution. The thickness may preferably be 0.05–10 microns, particularly 0.1–3 microns.

In the charge generation layer in the form of a dispersion, oxytitanium phthalocyanine and the binder resin may be mixed in a weight ratio of 1:5–5:1, preferably 1:2–3:1. A proportion of oxytitanium phthalocyanine below 1:5 causes a noticeable decrease in sensitivity. On the other hand, in the case of a proportion exceeding 5:1, oxytitanium phthalocyanine is liable to cause agglomeration which results in a poor mechanical strength of the charge generation layer.

The charge-transporting material may be an ordinary one, examples of which may include: pyrazoline compounds, hydrazone compounds, stilbene compounds, triphenylamine compounds, benzidine compounds and oxazole compounds.

Such a charge-transporting substance may be dispersed together with a binder as described with reference to the charge generation layer and a solvent to form a coating liquid, followed by application thereof to form a charge transport layer.

As described above, the thickness of the charge transport layer may preferably be set to 22–50 microns, particularly 25–35 microns.

In the charge transport layer, the charge transporting material and the binder resin may be mixed in a weight ratio of 1:3–3:1, preferably 1:2–2:1. A proportion of the charge-transporting material of below 1:3 causes a decrease in sensitivity and an increase in residual potential due to a decrease in charge-transporting ability. In the case of the present invention where a thick charge transport layer is used, an increase in distance of carrier migration invites a decrease in mobility and is therefore not advisable. A proportion of the charge-transporting material exceeding the ratio of 3:1 results in a decrease in mechanical strength of the charge transport layer and a decrease in durability in repetitive use of the photosensitive member.

The respective layers may be formed by known coating methods, such as dipping, spray coating, beam coating, blade coating and spinner coating.

Next, an electrostatic latent image formation process in an electrophotographic apparatus will be explained.

The photosensitive member may be uniformly charged ordinarily by corona discharge or by direct charging comprising causing a charging member in the form of a roller or block to contact the photosensitive member. At this time, if carriers are locally injected from the charge generation layer to the charge transport layer or from the support through the charge generation layer to the charge transport layer to partly lower the surface potential, black spots on the white background are formed through the reversal development step. In the present invention, the charging step may be controlled so as to provide a dark part potential on the photosensitive member of 250–600V, preferably 300–550V.

Hereinbelow, some synthesis examples of oxytitanium phthalocyanine used in the present invention will be described.

Synthesis Example 1

A mixture of 50 g of phthalodinitrile, 22.5 g of titanium tetrachloride and 630 ml of $\alpha$-chloronaphthalene was subjected to 4 hours of stirring under heating at 240°–250° C. and under an $N_2$ stream to effect the reaction. The product was subjected to filtration to recover dichlorotitanium phthalocyanine, and a mixture thereof with 380 ml of conc. ammoniacal water was refluxed under heating for 1 hour. The product was washed with acetone by means of a Soxhlet's extractor to obtain 22 g of B-type oxytitanium phthalocyanine.

Synthesis Example 2

In 100 g of -chloronaphthalene, 5.0 g of o-phthalodinitrile and 2.0 g of titanium tetrachloride were stirred for 3 hours at 200° C. followed by cooling to 50° C. to precipitate a crystal. The crystal was recovered by filtration to obtain a paste of dichlorotitanium phthalocyanine, followed by washing with 100 ml of N,N-dimethylformamide at 100° C. under stirring and two times of washing with 100 ml of methanol at 60° C. The resultant paste was recovered by filtration and stirred in 100 ml of deionized water for 1 hour at 80° C., followed by filtration to obtain 4.3 g of a blue oxytitanium phthalocyanine crystal.

The resultant oxytitanium phthalocyanine crystal was dissolved in 150 g of concentrated sulfuric acid and then added dropwise to 1500 ml of deionized water at 20° C. under stirring to reprecipitate a crystal, followed by filtration and sufficient washing with water to obtain amorphous oxytitanium phthalocyanine. The resultant amorphous oxytitanium phthalocyanine in an amount of 4.0 g was subjected to stirring for suspension in 100 ml of methanol for 8 hours at room temperature (22° C.), followed by filtration and drying under reduced pressure to obtain low-crystalline oxytitanium phthalocyanine.

To 2.0 g of the resultant low-crystalline oxytitanium phthalocyanine, 40 ml of n-butyl ether was added, followed by milling with glass beads in the size of 1 mm for 20 hours at room temperature (22° C.) to obtain a liquid dispersion. The solid was recovered from the dispersion, followed by washing with methanol, sufficient washing with water and drying to obtain 1.8 g of a novel oxytitanium phthalocyanine crystal. An X-ray diffraction pattern of the above-prepared oxytitanium phthalocyanine crystal is shown in FIG. 1.

As is understood from FIG. 1, the oxytitanium phthalocyanine showed strong peaks at Bragg angles ($2\theta \pm 0.2$ degree) of 9.0 degrees, 14.2 degrees, 23.9 degrees and 27.1 degrees in X-ray diffraction pattern based on CuK$\alpha$ characteristic X-rays.

Figure 2:
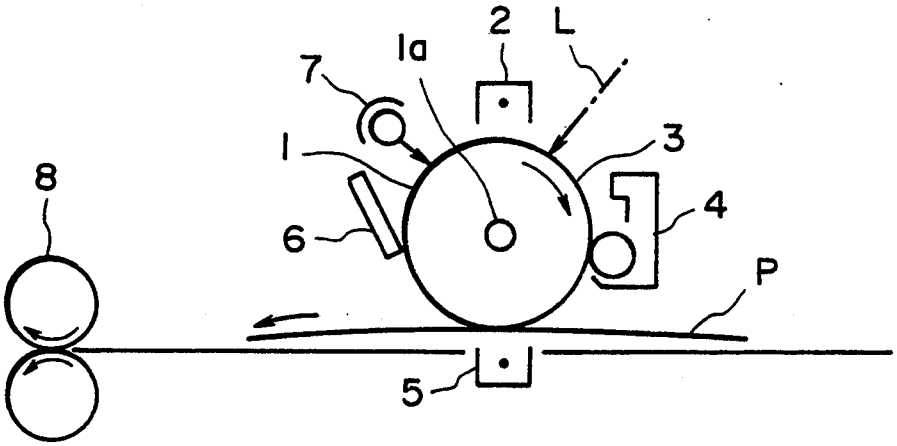
FIG. 2 is an illustration of an electrophotographic apparatus containing an electrophotographic photosensitive member according to the present invention.

FIG. 2 shows a schematic structural view of an ordinary transfer-type electrophotographic apparatus using an electrophotosensitive member of the invention. Referring to FIG. 2, a photosensitive drum (i.e., photosensitive member) 1 as an image-carrying member is rotated about an axis 1*a* at a prescribed peripheral speed in the direction of the arrow shown inside of the photosensitive drum 1. The surface of the photosensitive drum is uniformly charged by means of a charger 2 to have a prescribed positive or negative potential. The photosensitive drum 1 is exposed to light-image L (as by slit exposure or laser beam-scanning exposure) by using an image exposure means (not shown), whereby an electrostatic latent image corresponding to an exposure image is successively formed on the surface of the photosensitive drum 1. The electrostatic latent image is developed by a developing means 4 to form a toner image. The toner image is successively transferred to a transfer material P which is supplied from a supply part (not shown) to a position between the photosensitive drum 1 and a transfer charger 5 in synchronism with the rotating speed of the photosensitive drum 1, by means of the transfer charger 5. The transfer material P with the toner image thereon is separated from the photosensitive drum 1 to be conveyed to a fixing device 8, followed by image fixing to print out the transfer material P as a copy outside the electrophotographic apparatus. Residual toner particles on the surface of the photosensitive drum 1 after the transfer are removed by means of a cleaner 6 to provide a cleaned surface, and residual charge on the surface of the photosensitive drum 1 is erased by a pre-exposure means 7 to prepare for the next cycle. As the charger 2 for charging the photosensitive drum 1 uniformly, a corona charger is widely used in general. As the transfer charger 5, such a corona charger is also widely used in general.

According to the present invention, in the electrophotographic apparatus, it is possible to provide a device unit which includes plural means inclusive of or selected from the photosensitive member (photosensitive drum), the charger, the developing means, the cleaner, etc. so as to be attached or released as desired. The device unit may, for example, be composed of the photosensitive member and at least one device of the charger, the developing means and the cleaner to prepare a single unit capable of being attached to or released from the body of the electrophotographic apparatus by using a guiding means such as a rail in the body. The device unit can be accompanied with the charger and/or the developing means to prepare a single unit.

In a case where the electrophotographic apparatus is used as a copying machine or a printer, exposure light-image L may be given by reading a data on reflection light or transmitted light from an original or on the original, converting the data into a signal and then effecting a laser beam scanning, a drive of LED array or a drive of a liquid crystal shutter array.

Figure 3:
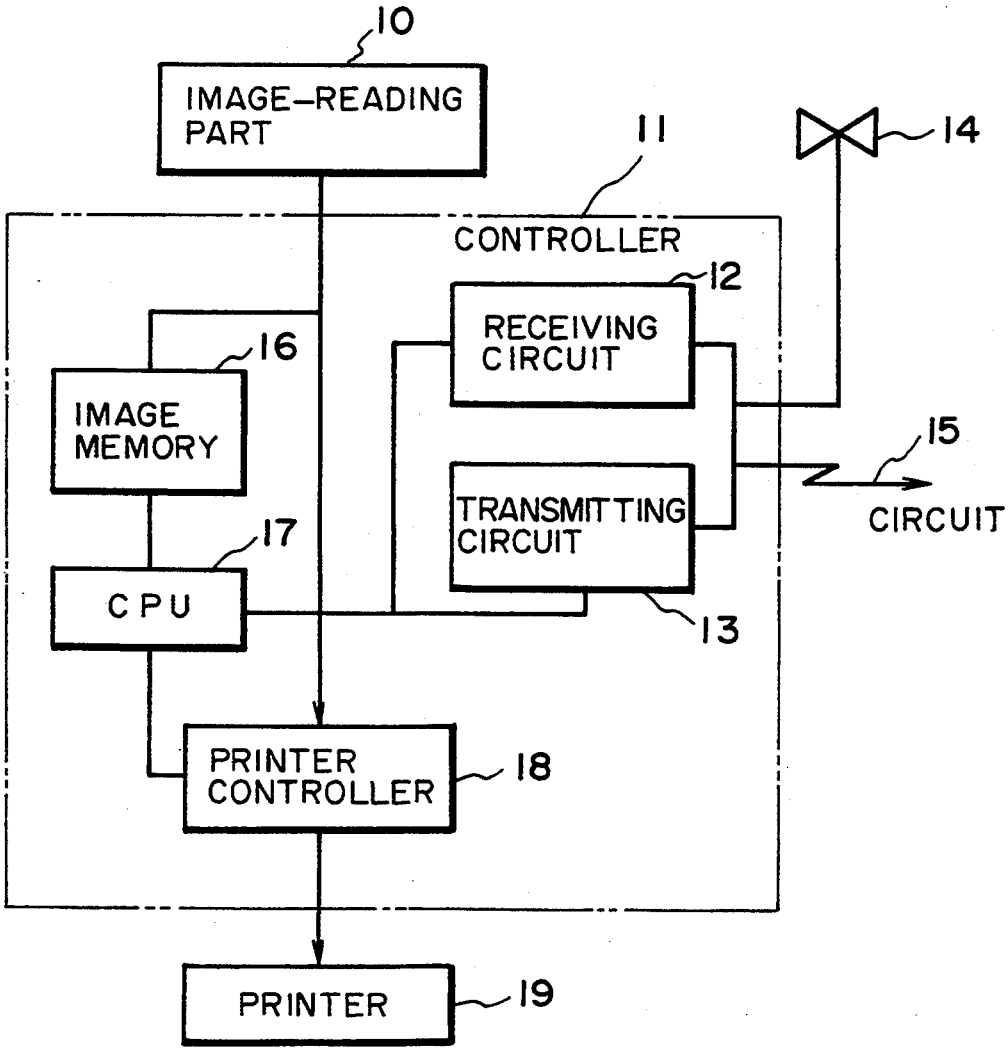
FIG. 3 is a block diagram of a facsimile machine using an electrophotographic apparatus of the invention as a printer.

In a case where the electrophotographic apparatus according to the present invention is used as a printer of a facsimile machine, exposure light-image L is given by exposure for printing received data. FIG. 3 shows a block diagram of an embodiment for explaining this case. Referring to FIG. 3, a controller 11 controls an image-reading part 10 and a printer 19. The whole controller 11 is controlled by a CPU (central processing unit) 17. Read data from the image-reading part is transmitted to a partner station through a transmitting circuit 13, and on the other hand, the received data from the partner station is sent to the printer 19 through a receiving circuit 12. An image memory memorizes prescribed image data. A printer controller 18 controls the printer 19, and a reference numeral 14 denotes a telephone handset.

The image received through a circuit 15 (the image data sent through the circuit from a connected remote terminal) is demodulated by means of the receiving circuit 12 and successively stored in an image memory 16 after a restoring-signal processing of the image data. When image for at least one page is stored in the image memory 16, image recording of the page is effected. The CPU 17 reads out the image data for one page from the image memory 16 and sends the image data for one page subjected to the restoring-signal processing to the printer controller 18. The printer controller 18 receives the image data for one page from the CPU 17 and controls the printer 19 in order to effect image-data recording. Further, the CPU 17 is caused to receive image for a subsequent page during the recording by the printer 19. As described above, the receiving and recording of the image are performed.

Hereinbelow, the present invention will be explained based on Examples wherein "part(s)" means "part(s) by weight" unless otherwise indicated specifically.

EXAMPLE 1

An Al cylinder having an outer diameter of 30 mm and a length of 260 mm was coated by dipping with an electroconductive layer-forming liquid comprising the following ingredients, followed by 30 minutes of heat-curing to form a 18 micron-thick electroconductive layer.

Electroconductive pigment: tin oxide-located titanate oxide 10 parts (trade name: CRONOS ECT-62, made by Titan Kogyo K. K.)

Resistivity-adjusting pigment: titanium oxide 10 parts

Binder resin: phenolic resin 10 parts (trade name: J-325, made by Dai-nippon Ink K.K.)

Surface roughness-imparting agent: spherical silicone resin powder 1.5 part (trade name: Tospal 120, made by Toshiba Silicone K.K.)

Solvent: methyl/methylcellulose=1/1 20 parts

Then, a 5%-solution of a polyamide resin (trade name: Amilan CM-8000, made by Toray K. K.) in methanol was applied onto the electroconductive layer by dipping to form a 1 micron-thick undercoating layer.

Separately, 10 parts of the oxytitanium phthalocyanine prepared in Synthesis Example 1, 4 parts of polyvinyl butyral resin (trade name: S-LEC BX-1, made by Sekisui Kagaku K. K.) and 200 parts of cyclohexanone were subjected to mixing and dispersion for 10 hours in a sand mill containing 1 mm-dia. glass beads, and then diluted with 500 parts of tetrahydrofuran. The resultant coating liquid was applied by dipping onto the undercoating layer to form 0.15 micron-thick charge generation layer.

Finally, for preparing a charge transport layer, 10 parts of a stilbene compound with a structural formula shown below and 10 parts of bisphenol Z-type polycarbonate resin (trade name: Z-200, made by Mitsubishi Gas Kagaku K. K.) were dissolved in 45 parts of monochlorobenzene and 15 parts of dichloromethane to form a coating liquid. The coating liquid was applied by dipping onto the charge generation layer to form a 26 micron-thick charge transport layer.

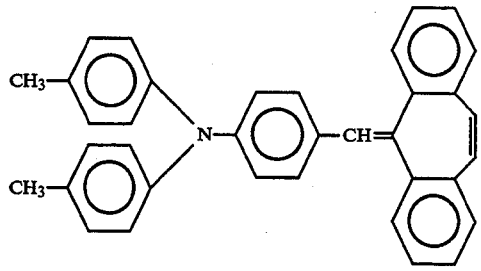

The thus prepared photosensitive member was attached to a commercially available laser beam printer of the reversal development mode equipped with a semiconductor laser light source (trade name: LBP-SX, made by Canon K. K.) and subjected to printing image evaluation wherein the charging conditions were set to provide Vd of −540V and V1 of −80V, and the development was performed by the jumping development scheme using a monocomponent negative toner under application of a developing bias voltage of −400V.

The results are shown in Table 1 appearing hereinafter.

EXAMPLE 2

A photosensitive member was prepared in the same manner as in Example 1 except that the thickness of the charge transport layer was reduced to 23 microns. The photosensitive member was subjected to the same image evaluation as in Example 1 except that the charging condition was adjusted to provide a Vd of −600V and a V1 of −90V and the development was performed under application of a developing bias voltage of −460V.

As a result, in the case of Example 1, high-quality letter images free from fog were stably obtained under various environmental conditions including normal temperature—normal humidity and high temperature—high humidity. On the other hand, in the case of Example 2 using a thinner charge transport layer and a higher Vd, good images were obtained under the normal temperature—normal humidity conditions, but some degree of black spots were observed in a high temperature—high humidity environment.

Further, both photosensitive members of Examples 1 and 2 were respectively subjected to a printing durability test of 10,000 sheets under normal temperature—normal humidity, good images not different from those at the initial stages were formed. After the test of 10,000 sheets, the potentials were Vd=−530V and V1=−85V for Example 1 and Vd=−590V and V1=95V for Example 2 and thus the potential changes were very small.

The results including the above are inclusively shown in Table 1.

EXAMPLE 3

A photosensitive member was prepared similarly as in Example 1. More specifically, the electroconductive layer, the undercoating layer and the charge generation layer were formed in the same manner as in Example 1. For preparation of a charge transport layer, 9 parts of a compound of the following structure.

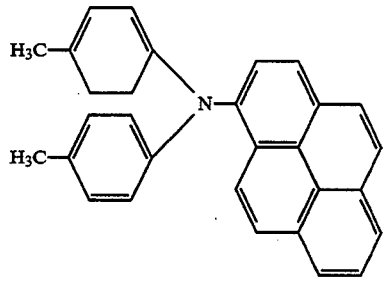

and 10 parts of styrene-acryl copolymer resin (trade name: MS-600, made by Shin-nippon Seitetsu Kagaku K. K.) were dissolved in 40 parts of monochlorobenzene and 12 parts of dichloromethane to form a coating liquid. The coating liquid was applied by dipping onto the charge generation layer to form a 24 micron-thick charge transport layer.

The thus prepared photosensitive member was attached to a laser beam printer identical to the one used in Example 1 and subjected to image evaluation under the conditions of Vd=−500V, V1=−60V and the developing bias voltage of −350V. The results are also shown in Table 1.

EXAMPLE 4

A photosensitive member was prepared in the same manner as in Example 3 except that the charge transport layer thickness was reduced to 22 microns and subjected to image evaluation in a similar manner as in Example 3 under the conditions of Vd=−580V, V1=−80V and the developing bias of −420V. The results are shown in Table 1.

EXAMPLE 5

A photosensitive member was prepared and evaluated in the same manner as in Example 1 except that the oxytitanium phthalocyanine prepared in Synthesis Example 2 was used.

The results are shown in Table 1.

Comparative Example 1

A photosensitive member was prepared and evaluated in the same manner as in Example 1 except that the charge transport layer thickness was set to 18 microns and Vd was set to −700V.

The results are shown in Table 1.

Comparative Example 2

A photosensitive member was prepared and evaluated in the same manner as in Example 3 except that a trisazo pigment was used as the charge-generating substance instead of the oxytitanium phthalocyanine.

The results are shown in Table 1.

The potentials after the durability test were as follows: Vd=−410V and V1=−70V.

TABLE 1

| | 23° C., 55% RH | | | | CTL*2 | Dark-part |
|---|---|---|---|---|---|---|
| | Initial | After 10,000 sheets | 23° C., 85% RH Initial | 32° C., 85% RH Initial | thickness (μm) | potential (-V) |
| Example 1 | Good*1 | →*3 | → | → | 26 | 540 |
| 2 | ↓*4 | → | → | Slight black | 23 | 600 |

TABLE 1-continued

| | 23° C., 55% RH | | | | CTL*2 | Dark-part |
|---|---|---|---|---|---|---|
| | Initial | After 10,000 sheets | 23° C., 85% RH Initial | 32° C., 85% RH Initial | thickness (μm) | potential (-V) |
| | | | | spots observed | | |
| 3 | ↓ | → | → | → | 24 | 500 |
| 4 | ↓ | → | → | Slight black spots observed | 22 | 580 |
| 5 | ↓ | → | → | → | 26 | 540 |
| Comp. Example 1 | ↓ | Slight black spots observed | Black spots observed | More black spots observed | 18 | 700 |
| 2 | ↓ | Fog observed entirely | ↓ | ↓ | 24 | 500 |

*1Good = Good image free from fog and good printed letter quality.
*2CTL = Charge transport layer.
*3→ = The same as the left.
*4↓ = The same as the above.

What is claimed is:

1. An electrophotographic photosensitive member to be used in an electrophotographic apparatus provided with charging means and reversal developing means, comprising: an electroconductive support, a charge-generation layer and a charge transport layer, in this order; wherein the charge generation layer comprises oxytitanium phthalocyanine, and the charge transport layer has a thickness from 22 to 50 microns.

2. A photosensitive member according to claim 1, wherein said oxytitanium phthalocyanine has a crystal form characterized by main peaks specified by Bragg angles ($2\theta \pm 0.2$ degree) of 9.0 degrees, 14.2 degrees, 23.9 degrees and 27.1 degrees in X-ray diffraction pattern based on CuKα characteristic X-rays.

3. A photosensitive member according to claim 1, wherein the charge transport layer has a thickness of 25 microns or larger.

4. A photosensitive member according to claim 1, wherein an undercoating layer is disposed between the electroconductive support and the charge generation layer.

5. A photosensitive member according to claim 4, wherein an electroconductive layer is disposed between the electroconductive support and the undercoating layer.

6. A photosensitive member according to claim 1, which further includes a surface protective layer.

7. A photosensitive member according to claim 1, which is negatively charged by the charging means.

* * * * *